US010309085B1

(12) United States Patent
Choy

(10) Patent No.: US 10,309,085 B1
(45) Date of Patent: Jun. 4, 2019

(54) HAIR AND DETRITUS CATCHING DEVICE

(71) Applicant: Kai Wai Choy, Greer, SC (US)

(72) Inventor: Ka Shan Choy, Alexandria, VA (US)

(73) Assignee: Kai Wai Choy, Greer, SC (US)

( * ) Notice: Subject to any disclaimer, the term of this patent is extended or adjusted under 35 U.S.C. 154(b) by 0 days.

(21) Appl. No.: 15/869,622

(22) Filed: Jan. 12, 2018

(51) Int. Cl.
*E03C 1/262* (2006.01)

(52) U.S. Cl.
CPC ..... *E03C 1/262* (2013.01)

(58) Field of Classification Search
CPC ..... E03C 1/262
USPC ..... 4/287
See application file for complete search history.

(56) References Cited

U.S. PATENT DOCUMENTS 1,640,198 A * 8/1927 Lobit ..... B01D 35/10 210/407
1,935,128 A * 11/1933 Pullman ..... E03C 1/264 4/286
3,959,831 A * 6/1976 Hendricks ..... E03C 1/264 4/287
5,003,642 A * 4/1991 Robb ..... E03C 1/262 210/164
5,265,281 A * 11/1993 McAlpine ..... E03C 1/262 4/287
6,088,843 A * 7/2000 Francisco ..... E03C 1/264 4/289
D439,957 S * 4/2001 Barnett ..... E03C 1/264 D23/261
6,276,017 B1 * 8/2001 Lino ..... B08B 9/0553 15/104.061
7,725,960 B2 * 6/2010 Markaj ..... B01D 35/10 4/256.1
D650,471 S * 12/2011 Du ..... E03C 1/264 D23/268
D698,103 S * 1/2014 Muhr ..... A03C 1/262 D30/124
2009/0271919 A1 * 11/2009 Scorvo ..... E03C 1/262 4/287
2010/0071122 A1 * 3/2010 Li ..... E03C 1/262 4/287
2010/0115689 A1 * 5/2010 Thompson ..... E03C 1/264 4/287
2013/0185855 A1 * 7/2013 Ali ..... A47K 1/14 4/287
2014/0007334 A1 * 1/2014 Golibart ..... E03C 1/262 4/287

* cited by examiner

*Primary Examiner* — Lori L Baker

(57) ABSTRACT

A hair and detritus catching device with one or multiple offset layers of prongs that can be positioned in any drain pipes and can be easily removed for cleaning or replacement. It is out of sight for normal usage and allows water to flow through easily while preventing hair and detritus from clogging up the drain pipe. It can be attached to a stopper or other connection mechanisms suitable for the type of drain, in order to allow for normal opening and closing operation of the drain.

6 Claims, 11 Drawing Sheets

HAIR AND DETRITUS CATCHING DEVICE

BACKGROUND OF THE INVENTION

Drains often get slowed down or clogged by hair, debris, and other detritus with normal use after a period of time. Long strands of hair can particularly be responsible for the slowdown of normal drain flow causing blockages. Many products have attempted to address the problem and are on the market. Previous attempts try to strain out all the debris and detritus, but they slow down the flow of water dramatically or they don't work as well as claimed. Existing products could also be unsightly because the straining mechanism is visible during normal usage and the user can see all the debris and detritus collected and captured. With respect to bathroom sink drains, there is also a problem of removing the drain stopper easily. Most drain stoppers include beneath sink attachments that require users to remove it from underneath the sink which is not conducive for cleaning. While those devices which can be removed from the top often leave the drain closing and opening mechanics useless.

A need exists for a product that can prevent the slowdown and clogging of drains, allowing for drain stopper operability, and providing ease of access for clearing the collected and captured debris and detritus.

BRIEF SUMMARY OF THE INVENTION

A hair and detritus catching device that can be used in any type of drain pipe comprising multiple offset layers of upward facing prongs surrounding a central rod. For example, a sink drain detritus catching device can require three offset layers of eight prongs. First layer can be aligned to 0°, 45°, 90°, 135°, 180°, 225°, 270°, 315°. Second layer can be aligned to 22.5°, 67.5°, 112.5°, 157.5°, 202.5°, 247.5°, 292.5°, 337.5°. The third layer can be aligned the same way as the first layer. That increases the likelihood of detritus being captured in different layers. It can be attached to a stopper or other connection mechanisms suitable for the type of drain in order to allow for normal opening and closing operation of the drain, in addition to matching the existing look of the drain. For a bathroom sink drain, there is also a E-shaped attachment positioned at the bottom that is attached offset to the central rod and extends parallel to the horizontal rod that extends below the sink. The user can lower the device with the "E" parallel the horizontal rod until one of the two openings in the "E", depending on the desired height of the stopper, catches the horizontal rod by rotating the device by 90°. Additional levels can be added to the E-shape attachment if needed to accommodate different drain lengths.

DETAILED DESCRIPTION OF THE INVENTION

In the following description, certain specific details are set forth in order to provide a thorough understanding of various disclosed embodiments. However, one of ordinary skill in the relevant art will recognize that embodiments may be practiced without one or more of these specific details. In other instances, well-known features or structures associated with fluid basins, drain systems, drain stoppers and strainers may not be shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1:
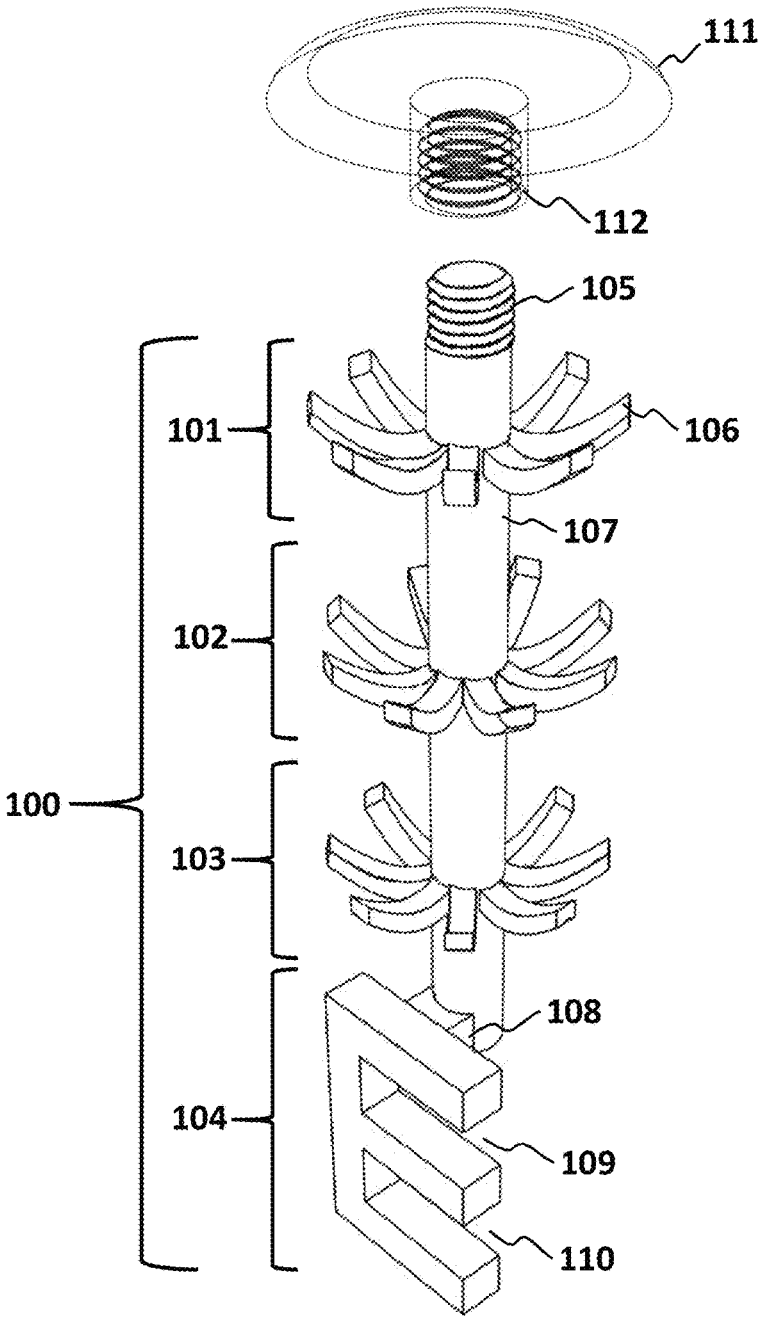
FIG. 1 is a perspective, top-down angled view of an embodiment of the present invention with a stopper.

FIG. 1 illustrates the present embodiment of a hair and detritus catching device 100. It comprises a central rod 107, a top male connection 105 to a drain stopper 111, multiple offset layers of prongs 101-103 that fit inside a drain pipe, and a bottom off-center "E" connection 104. The top connection 105 shows a male screw threaded rod that can be connected to a suitable drain stopper 111 with a female screw receptor 112 with the visible part matching the look of the sink basin. The prongs 106 can be arranged as shown. In layer 101, the prongs 106 are aligned to 0°, 45°, 90°, 135°, 180°, 225°, 270°, 315°. In second layer 102, the prongs 106 are aligned to 22.5°, 67.5°, 112.5°, 157.5°, 202.5°, 247.5°, 292.5°, 337.5°. The third layer 103 prongs are aligned the same way as the first layer 101. The prongs in an arrangement like so can increase the likelihood of detritus being captured in different layers. The bottom off-center "E" connection 104 is an example of how this device can be installed to work with an existing sink basin mechanism as shown in FIG. 2.

Figure 2:
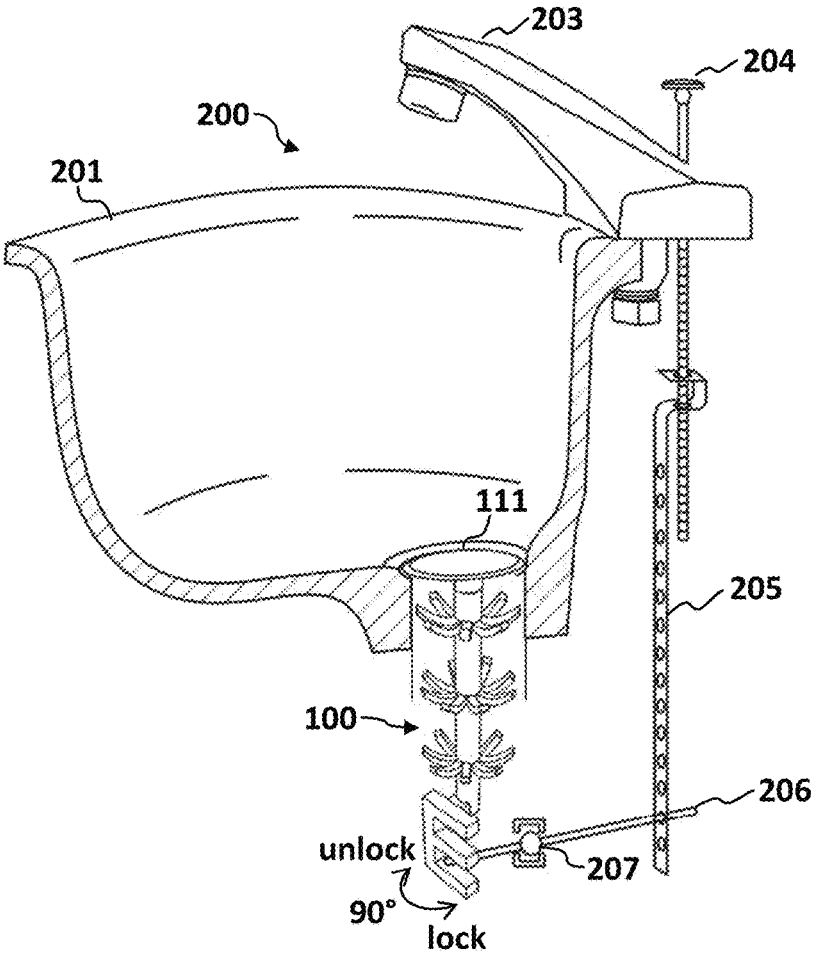
FIG. 2 is a perspective, partial cross-sectional view of a sink basin including an embodiment of the present invention.
Figure 3:
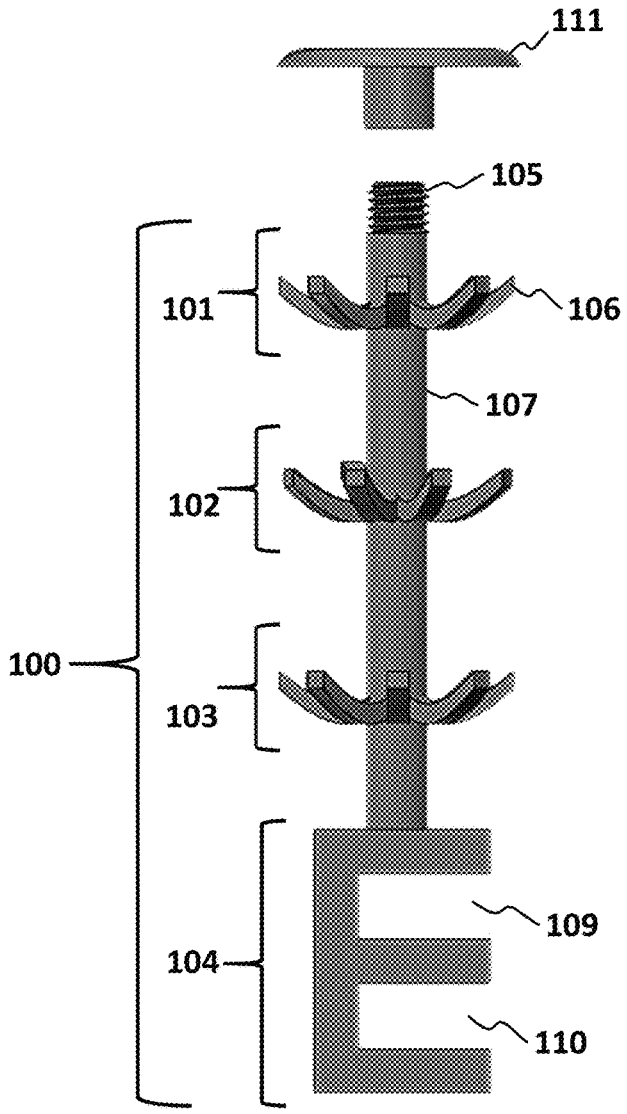
FIG. 3 is a perspective, left side view of an embodiment of the present invention with a stopper.
Figure 4:
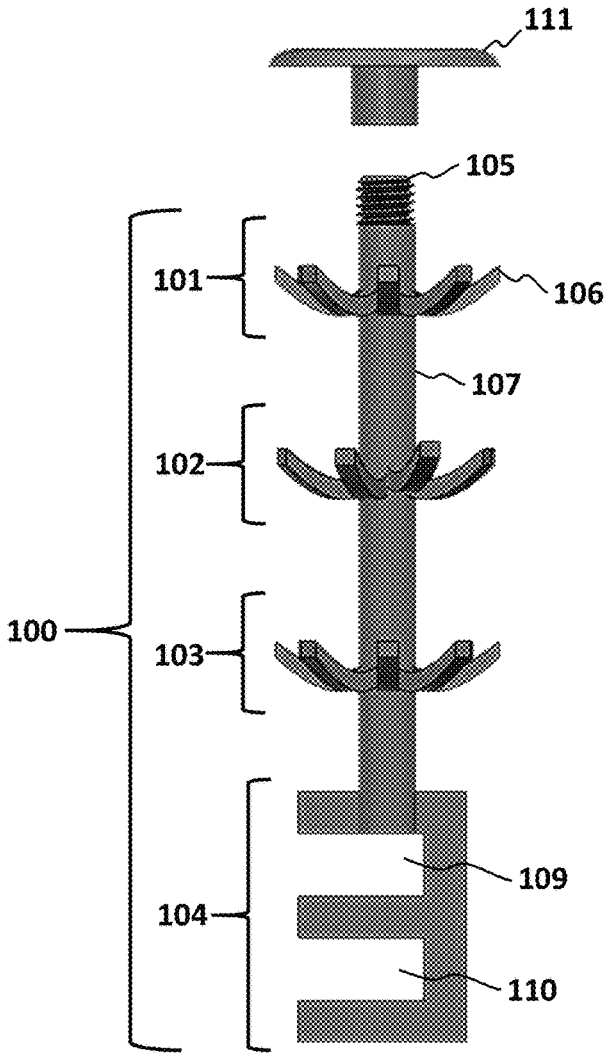
FIG. 4 is a perspective, right side view of an embodiment of the present invention with a stopper.
Figure 5:
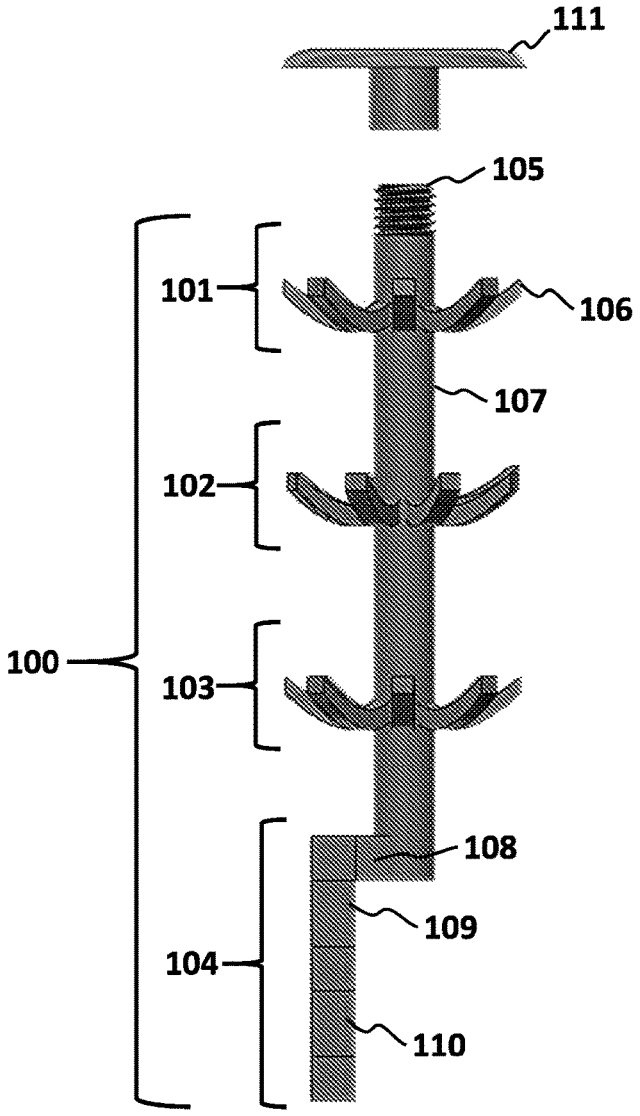
FIG. 5 is a perspective, front view of an embodiment of the present invention with a stopper.
Figure 6:
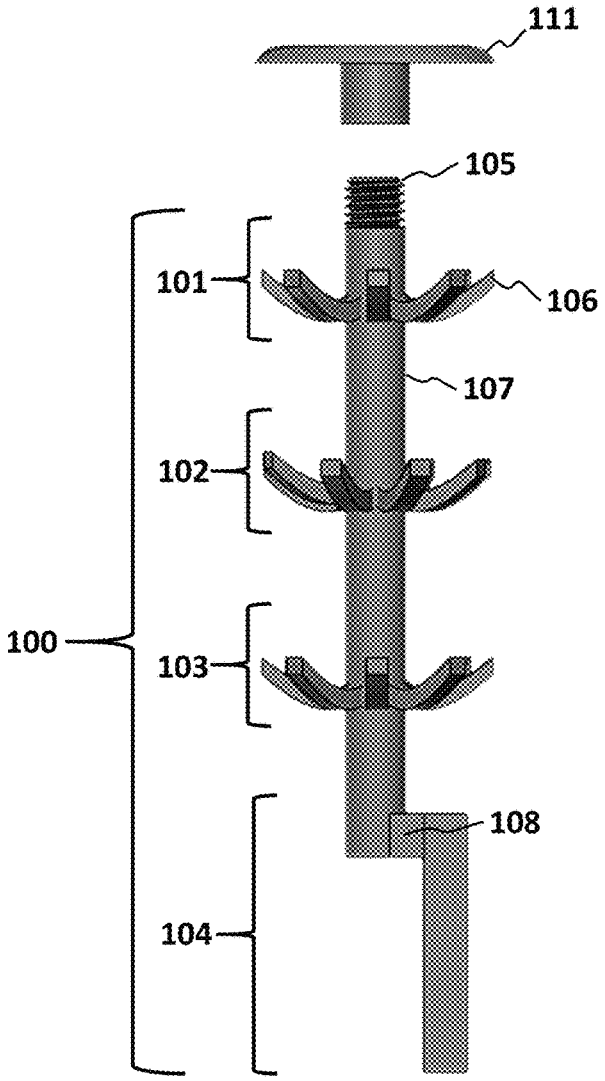
FIG. 6 is a perspective, back view of an embodiment of the present invention with a stopper.
Figure 7:
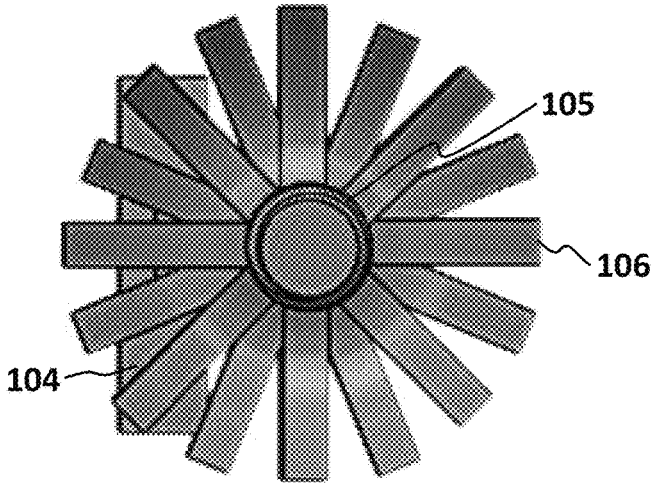
FIG. 7 is a perspective, top view of an embodiment of the present invention.
Figure 8:
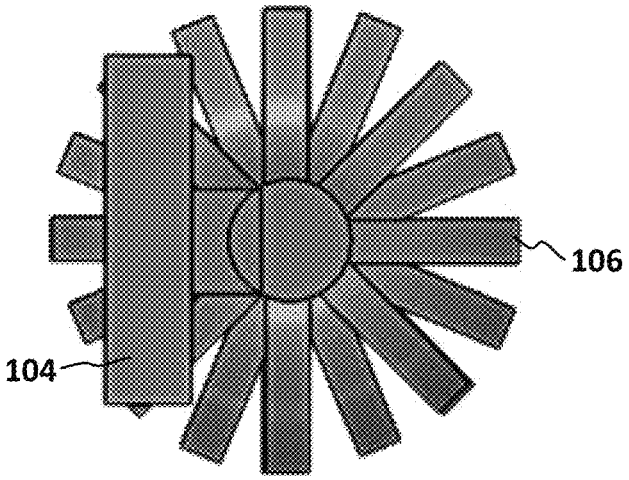
FIG. 8 is a perspective, bottom view of an embodiment of the present invention.
Figure 9:
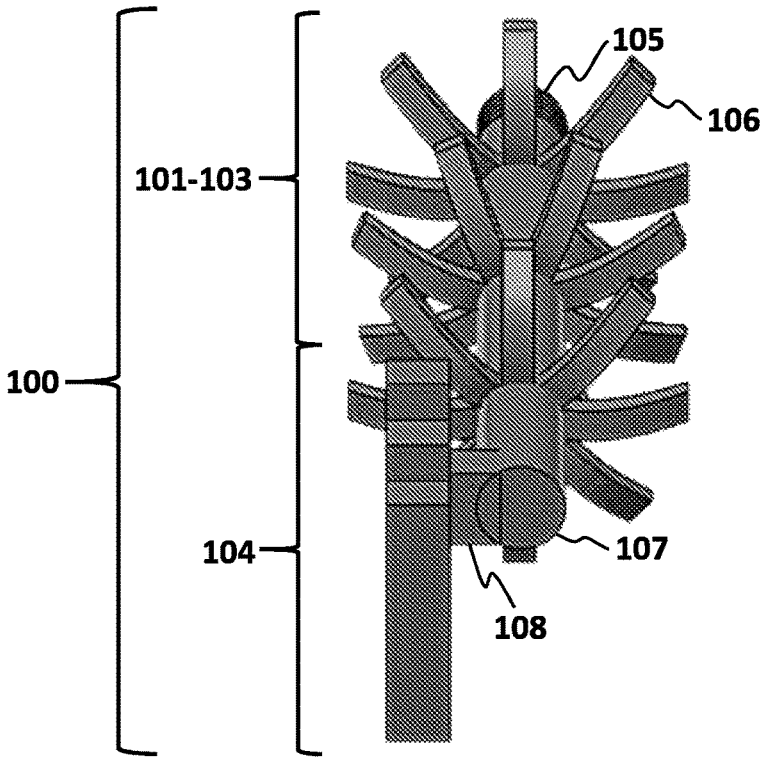
FIG. 9 is a perspective, bottom-top front angled view of an embodiment of the present invention.

FIG. 2 illustrates how the present embodiment as shown in FIG. 1 can work with an existing drain stopper system 200. The drain stopper system 200 includes a sink basin 201, a faucet 203, a lift rod 204, a clevis 205, a horizontal pivot rod 206, and a pivot ball 207. The lift rod 204 controls the clevis 205 which in turn controls the horizontal pivot rod

206. The horizontal pivot rod 206 moves upward or downward and thereby raising or lowering the drain stopper 111 attached to the hair and detritus catching device 100 to selectively fill or drain the sink basin.

The embodiment's bottom off-center "E" connection 104 is positioned perpendicular to the horizontal pivot rod 206 with the bottom of the opening in the "E" catching the horizontal pivot rod. This allows the embodiment to operate the normal opening and closing mechanism of the drain in addition to catching detritus like hair and other debris that might go through the drain. The user can easily install the embodiment from the top of the sink by lowering the device with the "E" parallel to the horizontal rod until one of the two openings in the "E", depending on the desired height of the stopper, catches the horizontal rod by rotating the device by 90°. This prevents the user from having to go underneath the sink to detach the drain assembly in order to clean the sink pipe regularly. The bottom off-center "E" connection 104 may have additional levels to accommodate different drain lengths.

The embodiment can be positioned in any drain pipes not limited to what's shown and can be easily removed for cleaning or replacement. It can be made of plastic, metal or a suitable material generally known in the art. It is out of sight for normal usage and it allows water to flow through easily while preventing hair and detritus from clogging up the drain pipe. It can be attached to a suitable stopper or other connection mechanisms for the type of drain in order to allow for normal opening and closing operation of the drain.

FIGS. 3-9 illustrate the embodiment from different viewing angles.

Figure 10:
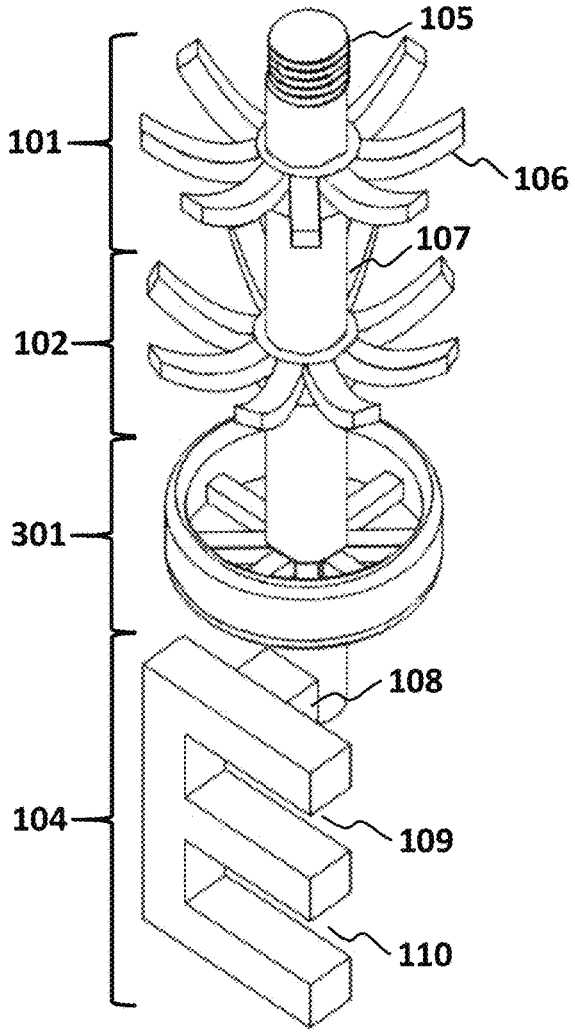
FIG. 10 is a perspective view of another embodiment of the present invention with an optional wheel shaped layer instead of prongs.

FIG. 10 shows a second embodiment where the third layer of prongs 103 is replaced with an optional wheel shaped layer 301 consisting of several spokes surrounded 304 with a deep circular side 302 to capture additional debris while the openings 303 allow water to flow through.

Figure 11:
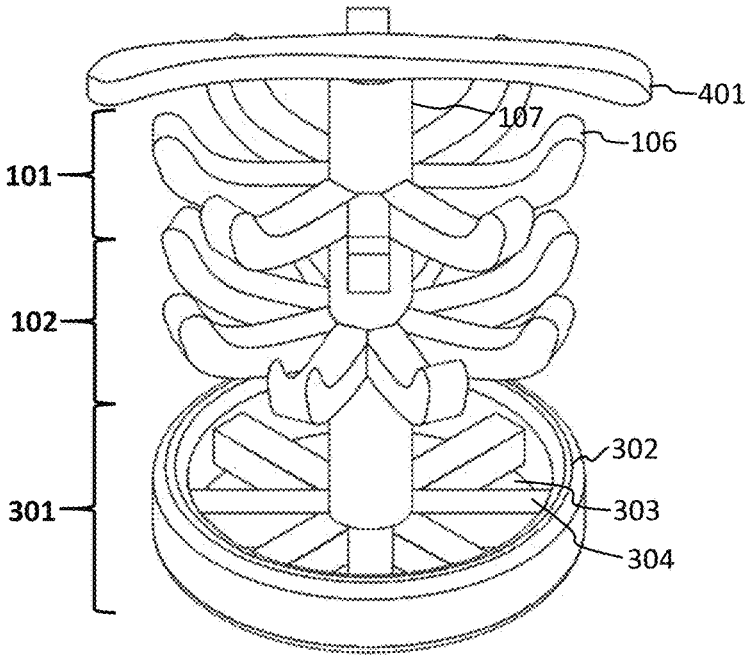
FIG. 11 is a perspective view of another embodiment of the present invention with a different upper connection mechanism.

FIG. 11 shows a third embodiment that could be used in a shower drain where the stopper is replaced with a bar type upper attachment mechanism 401. This allows the embodiment to attach to the drain pipe underneath the drain plate that is commonly used in this type of shower arrangement.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A hair and detritus capturing device for use in drain pipes, the detritus capturing device comprising:

a central rod;

multiple offset layers of upward facing prongs with openings in between the prongs which allow water to flow through easily while preventing hair and detritus from clogging up the drain pipes;

an upper attachment mechanism at one end;

and a multilevel lower attachment mechanism at an opposite end.

2. The hair and detritus capturing device of claim 1, wherein the upper attachment mechanism consists of a male screw threaded rod for attaching a drain stopper.

3. The hair and detritus capturing device of claim 1, wherein the multilevel lower attachment mechanism consists of several prongs protruding from the central rod in a perpendicular fashion.

4. The hair and detritus capturing device of claim 1, wherein the multiple offset layers of upward facing prongs consist of several equidistant offset prongs forming the shape of an upward facing claw crane, with each subsequent layer offset from the next layer to provide overlapping coverage protruding from the central rod.

5. The hair and detritus capturing device of claim 3, wherein the multilevel lower attachment mechanism consists of a bottom E-shaped attachment with multiple openings and two or more additional levels of prongs as horizontal bars that can be positioned to work with an existing sink basin mechanism including a horizontal pivot rod;

and where one of the multiple openings in the bottom E-shaped attachment can catch the horizontal pivot rod depending on the desired height of the upper end.

6. The hair and detritus capturing device of claim 4, wherein one layer consists of a wheel shaped layer with several spokes surrounded by a deep circular side in place of the prongs;

where the wheel shaped layer can capture additional debris;

and where the openings between the spokes allow water to flow through.

* * * * *